US007188500B2

(12) United States Patent
Bone

(10) Patent No.: US 7,188,500 B2
(45) Date of Patent: Mar. 13, 2007

(54) APPARATUS AND METHOD OF ROLLING SPLIT PIN CRANKSHAFTS

(75) Inventor: Bramwell W. Bone, Midland, MI (US)

(73) Assignee: Ingersoll CM Systems LLC, Midland, MI (US)

( * ) Notice: Subject to any disclaimer, the term of this patent is extended or adjusted under 35 U.S.C. 154(b) by 40 days.

(21) Appl. No.: 11/142,849

(22) Filed: Jun. 1, 2005

(65) Prior Publication Data

US 2006/0000254 A1 Jan. 5, 2006

Related U.S. Application Data

(60) Provisional application No. 60/575,860, filed on Jun. 1, 2004.

(51) Int. Cl.
*B21D 15/00* (2006.01)

(52) U.S. Cl. ..... 72/110

(58) Field of Classification Search ..... 72/107, 72/110; 29/6.01

See application file for complete search history.

(56) References Cited

U.S. PATENT DOCUMENTS

| | | | | |
|---|---|---|---|---|
| 2,841,861 | A | 7/1958 | Williams | |
| 2,876,528 | A | 3/1959 | Wulpi | |
| 4,299,017 | A | 11/1981 | Gottschalk | |
| 4,561,276 | A | 12/1985 | Berstein | |
| 4,747,286 | A | 5/1988 | Berstein et al. | |
| 5,001,917 | A | 3/1991 | Berstein | |
| 5,058,261 | A | 10/1991 | Kitamura | |
| 5,235,838 | A | 8/1993 | Berstein | |
| 5,333,480 | A | 8/1994 | Berstein | |
| 5,445,003 | A | 8/1995 | Gottschalk et al. | |
| 5,493,761 | A | 2/1996 | Bone | |
| 5,495,738 | A | 3/1996 | Gottschalk | |
| 5,575,167 | A | 11/1996 | Gottschalk et al. | |
| 6,360,574 | B1 * | 3/2002 | Vodopyanov | 72/110 |
| RE37,794 | E | 7/2002 | Egbert | |
| 6,786,073 | B2 | 9/2004 | Bone | |
| 6,895,793 | B2 | 5/2005 | Heffron et al. | |
| 7,021,100 | B2 * | 4/2006 | Heimann | 72/110 |
| 2005/0066699 | A1 * | 3/2005 | Bagusche | 72/110 |

FOREIGN PATENT DOCUMENTS

| | | |
|---|---|---|
| JP | 5-253756 | 10/1993 |

* cited by examiner

*Primary Examiner*—Ed Tolan
(74) *Attorney, Agent, or Firm*—Fitch, Even, Tabin & Flannery

(57) ABSTRACT

A method and apparatus are provided for rolling outer fillets of arcuately offset, split pin bearings on crankshafts with a pair of work rollers, each pair engaging and rolling a respective outer pin fillet. A backup roller is positioned opposite the pair of work rollers. The work rollers may be positioned above and below a centerline of the split pin, preferably about 90° apart. The work rollers can perform identical rolling operations at identical pressure and the work rollers and backup rollers are positioned to keep the adjacent tool heads in parallel planes during these rolling operations. Rolling arms carry the tool heads and stops are provided to keep rear portions of the tool arms in parallel planes against sideways forces. The work rollers and the backup roller may be mounted on the same tool arm and are movable relative to each to clamp or release a pin bearing.

25 Claims, 4 Drawing Sheets

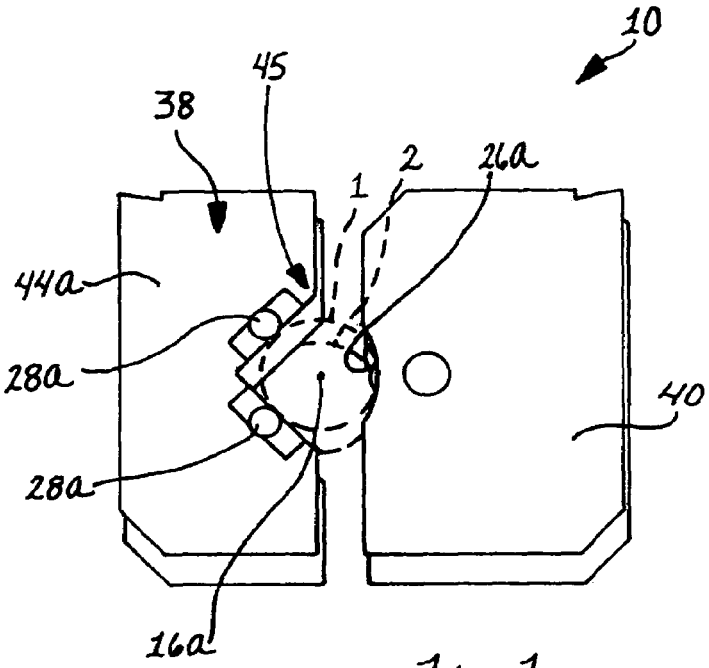
Fig. 1
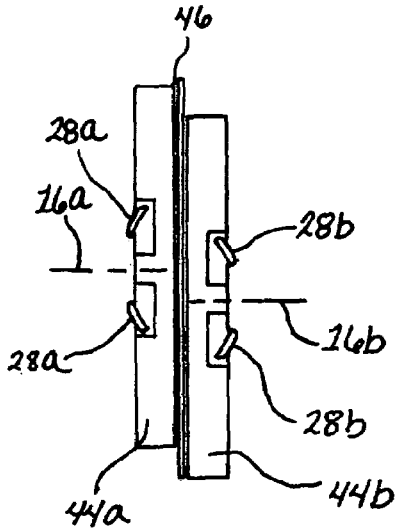
Fig. 3
Fig. 2
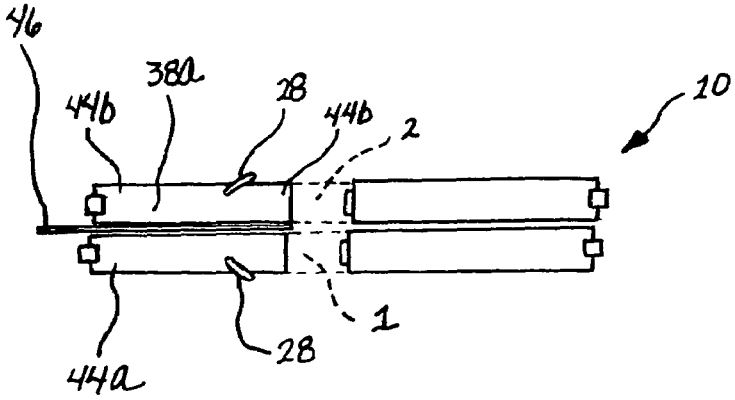

APPARATUS AND METHOD OF ROLLING SPLIT PIN CRANKSHAFTS

CROSS-REFERENCE TO RELATED APPLICATION

This application claims the benefit of U.S. Provisional application Ser. No. 60/575,860, filed Jun. 1, 2004, which is incorporated by reference as if reproduced in its entirety herein.

BACKGROUND OF THE INVENTION

An apparatus and method of rolling the outer fillets of split pin crankshafts by having tools rubbing together to absorb opposing forces are disclosed in Hegenscheidt's U.S. Pat. Nos. 5,575,167 and 5,445,003. The problem with this method using conventional single roller rolling tools is that because the split pins are on different centerlines, the opposing forces of the single fillet rollers cause the tools and rolling arms to twist, which in turn cause separation and excessive wear on the wear plates or friction devices between the tools.

More specifically, U.S. Pat. No. 5,575,167 discloses and illustrates in FIG. 6 non-adjacent fillets of adjacent split pins, i.e. the outer fillets of the adjacent split pins, which are rolled at a pressure by inclined work rollers. The rollers are mounted on adjacent tool heads to project out from the lower ends thereof. Each tool housing is mounted to an upper arm of a pair of scissor arms with the tool housing for the back-up rollers mounted to the lower arm. Accordingly, when the arms are shifted for clamping the rollers on the pin fillets, the lower projecting work roller of the upper arm tool housing will engage on the upper side of the fillet with the upwardly projecting pair of back-up rollers engaging on the lower side of the pin bearing, outside of the fillet area.

The arms are next to each other so that their tool heads are placed side-by-side during the rolling process. The opposing tool housings of the work rollers have a central bearing unit mounted therebetween to lessen the friction due to the opposing side loads generated during the simultaneous rolling of a pair of outer fillets of the split pin bearings. The central bearing unit is said to spread the side loads while allowing the housing of the tool heads to easily move relative to one another during rolling. As illustrated in FIG. 5 of this patent, a pair of backup rollers are provided on a tool arm disposed opposite the tool arm carrying a single operative working roller which imparts the rolling forces to roll harden the fillet. Because the adjacent pin bearings have axes which are offset to each other for the split bearing and with the working rollers and backup rollers positioned in this manner, the tool heads and/or the tool arms tend to bend or twist from a true vertical plane which results in undue stress and premature wear of both the rolling tool heads and the rolling arms. In production equipment where flat surfaces on the rolling tools or housings, which are supposed to rub together, try instead to separate, this action causes high wear in certain areas and premature failure.

More specifically, FIGS. 8A and 8B and 9A and 9B herein illustrates the prior art, as disclosed in FIG. 6 of U.S. Pat. No. 5,575,167, wherein a single working roller 94 is provided on each tool 70, 72 engaging split pin bearing fillets 95 and 97. Referencing the '167 patent, a pair of backup rollers 98 are carried on a tool 74, 76 on a second tool arm 80, and the single working roller 94 is carried on a first tool arm 78. When the left crank pin bearing is in its upper vertical position (FIG. 8A), there is generally a counterclockwise sideways force c about a horizontal axis normal to the crankshaft axis. When the right pin bearing is located in its upper vertical position (FIG. 8B), an oppositely directed clockwise sideways force c exists. When the left crank pin bearing is horizontal, as shown in FIG. 9A, a counterclockwise sideways force c about a vertical axis is generated. An opposite clockwise sideways force c is generated when the crankshaft has rotated 180° from FIG. 9B. These sideway forces c cause unwanted movements of the tool heads and the tool arms that can result in premature failure and high wear in certain areas.

In Ingersoll's U.S. Pat. No. 6,895,793, which is incorporated by reference as if reproduced in its entirety herein, there is disclosed a very thin rolling arm which carries both a single working roller and a pair of support rollers. It would be desirable to use the thin arms to roll split pin bearings. However, due to the large side forces exerted upon them during the rolling of the outer fillets of the split bearings of the crankshaft, the rolling tool arms will want to rock side-to-side in both the vertical and the horizontal positions of the pin bearing because the forces are consistently changing direction from side-to-side with each 180° rotation of the crankshaft, as explained above in connection with FIGS. 8 and 9 herein.

SUMMARY OF THE INVENTION

In accordance with the present invention there is provided a new method and apparatus for rolling of outer fillets of adjacent, split crank pin bearings using work rollers and tool arms which are stabilized from twisting sideways and, thus, keeping the tools to provide more equal pressure on the workpiece and limit the amount of rubbing between adjacent tool heads and any rocking of the tool arms.

In accordance with one aspect of the invention, work rollers are positioned on each of the adjacent rolling tool arms to roll outside fillets of adjacent, split pin bearings on a crankshaft and the pin fillets are engaged by at least one backup roller positioned relative to a pair of work rollers to provide equal pressure to the pins which tends to keep the tool heads in a parallel planes relative to one another and thereby lessen an uneven distribution of reactive forces. Thus, the rolling tools are maintained perpendicular to their respective bearing centerlines of the pins and to the axis of the crankshaft. Preferably, one of the work rollers will be above a horizontal plane through the bearing centerline and the other roller will be below the plane. The forces above and below the centerline will, thus, tend to equalize so that the housing is not urged to tip or twist sideways about the bearing centerline along the crankshaft axis. In this manner, the tool housings tend to stay more vertically oriented in a direction perpendicular to the bearing centerline and the crankshaft axis. In the preferred method, there is a single backup roller on the opposite side of the crankshaft which forms a triangle of engagement points with the pair of engagement points provided by the opposed pair of work rollers. In the preferred embodiment, the work rollers are positioned at about substantially 45° and above and below the pin axis for each of the split pin bearings with the backup roller being positioned opposite from the working rollers and equally spaced relative thereto. That is, the work rollers are spaced 90° apart.

In accordance with another aspect, the pair of adjacent tool arms are maintained in a parallel relationship to minimize or lessen any rocking which would tend either to separate the rearward portions thereof or to bring these rearward ends closer together. The stabilization of the rear portions of the adjacent arms, for example, to maintain them in a pair of adjacent vertical planes, is preferably provided by stops which limit the rear portions of the tool arms from shifting toward or from each other.

In accordance with the preferred embodiment, the work rollers and support rollers are positioned at the forward end when rolling outer fillets of the adjacent split pins to provide an even distribution of forces and pressures to maintain the rolling tools perpendicular to their respective bearing centerlines and axis of the crankshaft. Likewise the rear portions of the tool arms are provided with devices for stabilizing these portions of the adjacent arms to maintain a parallel relation therebetween.

In the preferred embodiment of the invention, the forward portion carries a pair of working rollers that are disposed on opposite sides of the centerline of the respective axes for the split pin bearings and with a single work roller positioned equidistantly from and in opposition to the pair of working rollers; and the rear portion of the tool arms is stabilized to maintain a parallel relationship between adjacent tool arms by suitable stops limiting the movement of the arms toward or from one another thereby maintaining their parallel relationship with each other, e.g., in vertical adjacent planes.

BRIEF DESCRIPTION OF THE DRAWINGS

FIG. 1 is a side elevational view of a pair of tools heads constructed in accordance with an illustrated embodiment of the invention;

FIG. 2 is a plan view of the heads of FIG. 1 showing the tools mounted on the rolling arms and showing the direction of forces exerted by the working rollers on the outer fillets of the split pin bearing;

FIG. 3 is a side elevational view showing a pair of tool assemblies with the working rollers thereof mounted on opposite sides of the pin bearing centerline;

DETAILED DESCRIPTION OF THE PREFERRED EMBODIMENTS

Figure 7:
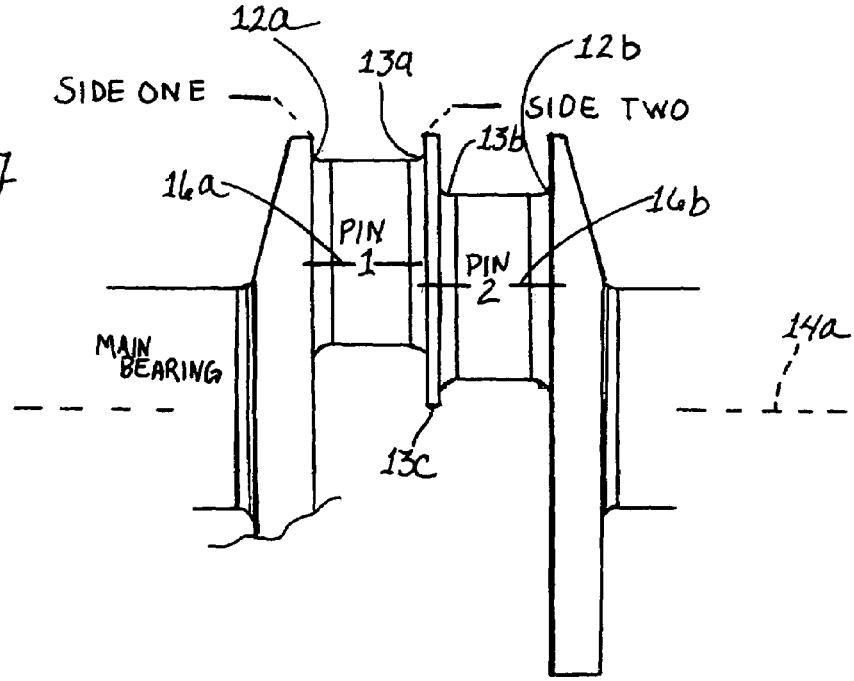
FIG. 7 is an illustration of a crankshaft having split pin bearings.
Figure 8A:
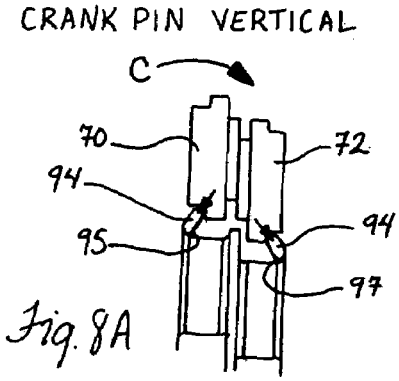
FIGS. 8A and 8B disclose a prior art rolling process generating sideway forces during rolling with the pins vertical.
Figure 8B:
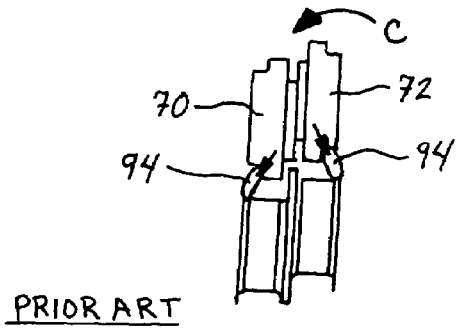
Figure 9A:
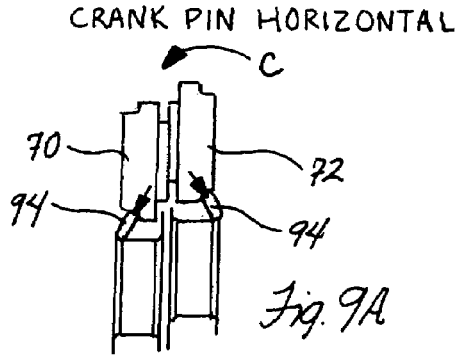
FIGS. 9A and 9B disclose a prior rolling process similar to FIGS. 8A and 8B with the pins horizontal.
Figure 9B:
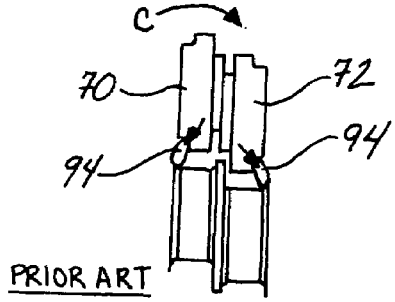

As disclosed in the illustrated embodiment, there is provided an apparatus 10 for rolling a pair of outer split pin fillets 12 and 12*a* (FIG. 7) on a pair of respective split, arcuately offset pin bearings 1 and 2. The split bearings also have interior fillets 13*a* and 13*b* and a fence 13*c* between the bearings. For some crankshafts, only the outer fillets of the split pin bearings are desired to be rolled. The crankshaft 14 having the respective split pin bearings 1 and 2, has a central rotational axis 14*a* about which the crankshaft is rotated during the rolling process which strengthens the fillets in a well-known manner. As is well-known, the pressure applied to the fillets may be continuous or continuously varied or pulsed to provide the roll hardening forces to the fillets during the rolling process. Each of the arcuately offset, split pin bearings labeled "pin 1 and pin 2" in FIG. 7 also has its own respective central axis 16*a* and 16*b* which are offset vertically from one another as shown in FIG. 7 and which are offset with respect to their distance from the central crankshaft axis 14*a*. The respective pins and their axes 16*a* and 16*b* orbit about the crankshaft axis 14*a* as the outer pin fillets 12*a* and 12*b* are being rolled.

Figure 6:
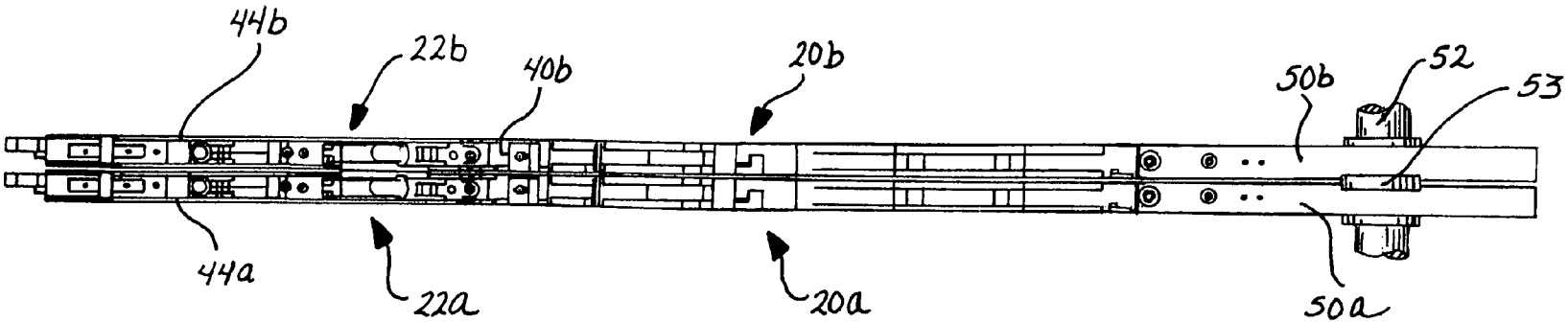
FIG. 6 is a plan view of a pair of tool arms such as shown in FIG. 5 with outer side stops and an inner, spacer stop to stabilize the rear portion of the tool arms and to maintain them in parallel relationship with one another.
Figure 5:
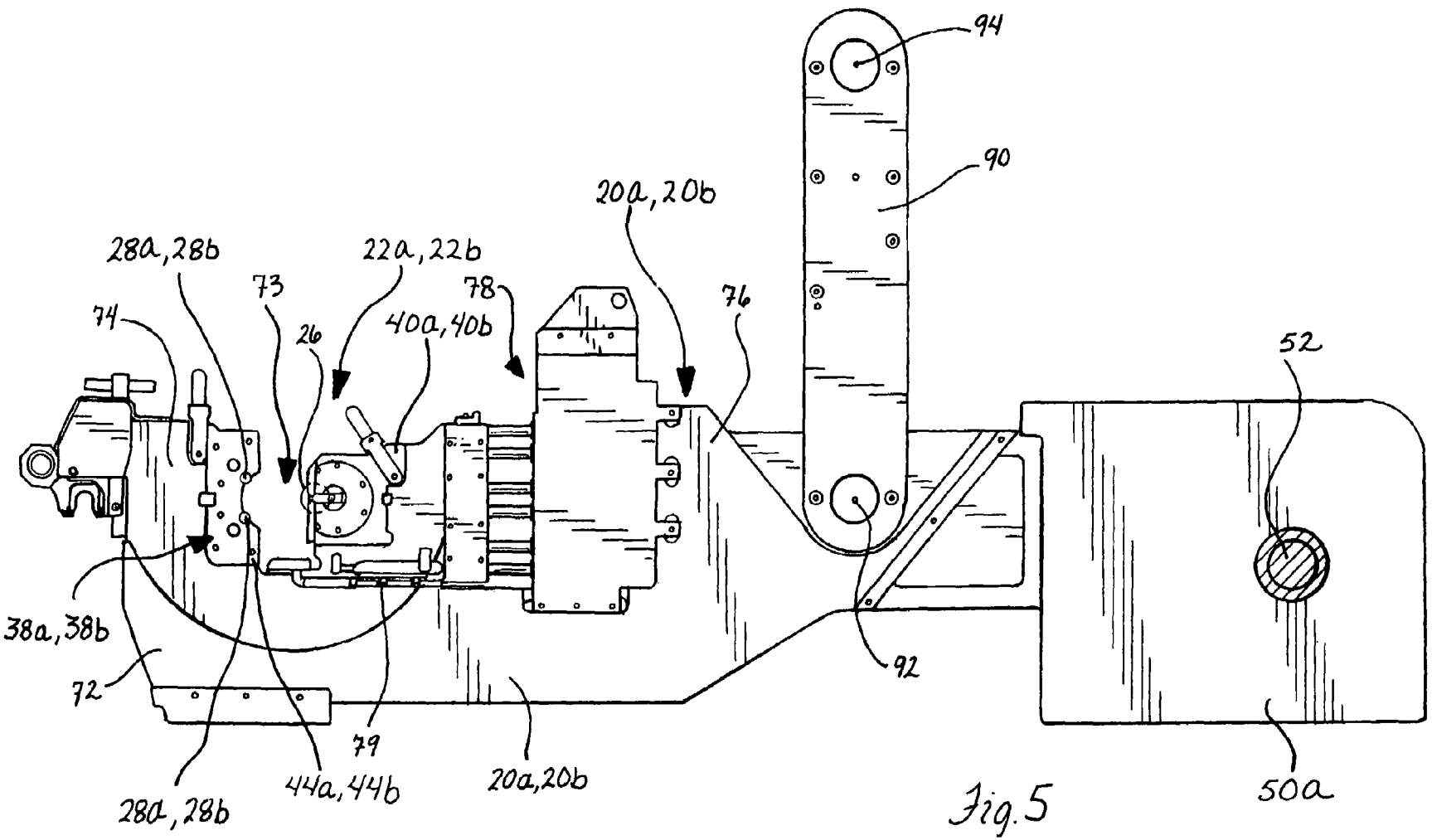
FIG. 5 is a side elevational view of a rolling tool arm on which is mounted the tools for rolling the outer fillet of a split pin bearing.

As disclosed in the aforementioned '167 and '003 patents, the outer fillets of adjacent, arcuate split pin bearings are rolled by the apparatus which has tool arms 20*a* and 20*b*, as best seen in FIGS. 5 and 6. The arms are supported for a rocking movement to follow the orbital path of the respective pin bearings as they are moved about the crankshaft axis 14*a*. Each of the tool arms carries a tool head 22*a* and 22*b* which are mounted on the outer or forward ends of the respective arms 20*a* or 20*b*. The tool heads carry at least one backup roller 26 and two working rollers 28 in this illustrated embodiment.

Figure 4:
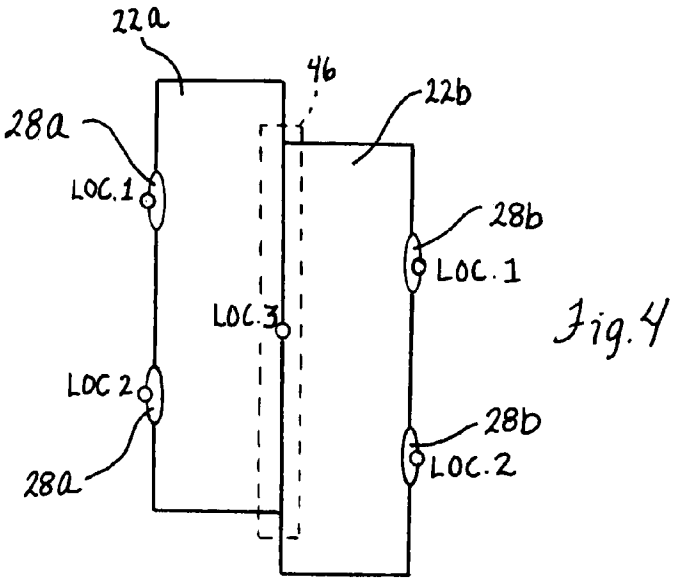
FIG. 4 is a diagrammatic view showing the forces of two tool heads pushing against each other and the areas of contact between a pair of adjacent tools for rolling outer fillets of adjacent split pin bearings.

Referring now in greater detail the illustrated embodiment as shown in FIGS. 5 and 6. Each of the tool heads 22*a* and 22*b* comprises a working roller or assembly 38*a* or 38*b* (FIG. 5) of the tool head on one side of the pin and a backup roller assembly 40*a* or 40*b* of the tool head on the other side of the pin. Each of the working roller assemblies 38*a* and 38*b* includes a narrow housing body 44*a* and 44*b* having the width approximately that of a pin bearing except, in one form, for the thickness of a wear plate 46 (FIGS. 2, 3 and 4). The wear plate 46 can be mounted between the respective housing bodies for being engaged thereby and resisting the opposing forces which are pushing the respective housing bodies toward each other and against opposite sides of the wear plate.

As seen in FIGS. 1 and 2, the housing body 44*a* has a pair of working rollers 28*a* which are rotatably mounted in the housing so as to allow these rollers to rotate during the crankshaft rolling operation. As best seen in FIGS. 2 and 3, the rollers are mounted at an angle and project from a v-shaped cut-out 45 in the side walls facing the pin bearings of the housings to engage the fillets of the crankshaft. As described above, the respective working rollers 28*a* for the housing 44*a* and of the working rollers 28*b* for the housing 44*b* are each aligned on one side of the pin bearing spaced ninety degrees from each other around the respective engaged fillets thereof. As seen in these figures, the working rollers 28*a* and 28*b* extend from each side of their respective two housing 44*a* and 44*b* at an outward angle or cant relative to the housing and to each other for engaging in opposite outer fillets of adjacent, arcuately offset split pin bearings. In a preferred embodiment of the invention and referring to FIG. 4, the housing 44*a* is a steel body and the housing 44*b* is a bronze body that can engage each other without the need for a separate wear plate 46. With the above-described arrangement of the tools and rollers, it is anticipated that the forces tending to tip or twist the tool heads sideways will be much lower and more uniform than present in prior arrangements for rolling split pin bearings. Accordingly, the need for a separate wear plate may be obviated. On the other hand, the housings of the backup roller assemblies 40*a* and 40*b* are preferably spaced from each other and will not engage with rolling operations of the apparatus 10 herein.

As best seen in FIG. 3, the pair of working rollers 28*a*, mounted in the housing body 44*a*, are doing the rolling of the fillet 12*a* which has axis 16*a* for the bearing 1 which is located vertically higher than the axis 16*b* for the pin bearing 2 and each of the respective rollers 28*a* are disposed at equal distances from the axis 16*a* and likewise each of the working rollers 28*b* are disposed at equal heights or distances relative to the centerline 16*b* for the pin bearing 2. As explained above, it is preferred to have the work rollers above and below the centerline and at equal spacings to assist in stabilizing the tool from sideways tipping or twisting such as has been described with respect to prior art FIGS. 8A, 8B, 9A and 9B.

Likewise, to assist in stabilizing the tool from twisting and to keep the respective tool heads 22*a* and 22*b* parallel to one another, it is preferred to have a single backup roller 26*a* on each of the respective backup roller assemblies 40*a* and 40*b*. Herein as seen in FIG. 1, the backup roller 26*a* has its axis aligned in a horizontal plane through the axis 16*a* for the pin number 1. Likewise the backup roller 26*b* in the backup roller assembly 40*b* is positioned with its axis aligned in a horizontal plane through the centerline 16*b* for the bearing pin 2.

Referring now to the diagrammatic illustration in FIG. 4, there are two working rollers 28*a* at spaced locations 1 and 2 above and below the pin centerline for the first pin being rolled by the tool head 22*a*. Likewise there are two working tools 28*b* at spaced locations 1 and 2 above and below the pin centerline for the second pin being rolled by the tool head 22*b*. Each tool 22*a* and 22*b* is being forced against the other while each is performing an identical rolling operation at identical pressures, the tool heads 22*a* and 22*b* forms a three point locator which keeps the tools and the rolling arms always in a vertical position by the virtue of the fact that the outer sidewalls of each tool head 22*a* and 22*b* is held securely by the locator of the crankshaft between end centers in the machine during the rolling operation.

Although the vertical planes for the respective tool heads 22*a* and 22*b* are kept parallel, as shown in FIG. 4, it is still possible that rear portions 50*a* and 50*b* of the respective tool arms 20*a* and 20*b* may be twisted or cocked or may have a side movement relative to a supporting shaft 90 (FIGS. 5 and 6). The particular mounting of the illustrated tool heads and their respective working roll assembly 38*a* and backup roller assembly 38*b* are described in detail in previously incorporated U.S. Pat. No. 6,895,793. Generally, the tool arm has a generally upwardly located rectangular cutout 73 in a front portion 72 of a tool arm 22*a* or 22*b* and has integral upstanding front and rear end walls 74 and 76 at the forward and rearward ends of the cutout 73. One of the tool housings assemblies 38*a* is fixed against the upstanding forward end wall 74 and the other is backed by the upstanding rear end wall 76. Herein, the support roller housing and support roller are driven along the length of the arm towards this fixed housing assembly 38*a* by a drive cylinder assembly 78. To provide more rigidity of the pair of working rollers 28*a* or 28*b*, it is preferred to have their working roller assembly 38*a* be disposed in a fixed position supported by the backup end wall 74 whereas the opposite backup assembly 40*a* or 40*b* is mounted for slidable movement by the cylinder assembly 78 fixed to the upper rear support end wall 76 at the end of the rectangular cutout 73 in the tool arm. Each of the tool arms 72 along with the drive cylinder assembly 78 have a very thin width in the axial direction (FIG. 6) that allows the adjacent tool arms to be positioned along one side of the crankshaft with each of the offset, split pin bearings being rolled simultaneously. For example, each of the thin rolling arms 22*a* and 22*b* might have a width, by example only, of 0.925 inch. Because of the very thin width of these tool arms and in order to be able to generate the necessary output force with such a thin arm and a thin cylinder assembly 78, the illustrated cylinder assembly has a number of vertically stacked hydraulic force actuators in the form of extendable, piston rods 84 which can be reciprocated and can be pushed horizontally outwardly from the cylinder to push a saddle that carries the backup roller housing 40*a* for linear sliding along bearings 79 attached to the bottom of the cutout arm 73 of the arm 72. Each of the respective backup rollers 30*a* and 30*b* are generally centered with respect to an opposing pair of working rollers 28*a* and 28*b*; and each backup roller is located with its axis in a horizontal plane through its associated split bearing axis 16*a* and 16*b*. The fluid cylinder 78 is actuated by a supply of high pressure power fluid to cause the piston rods 84 to extend, causing the saddle and the backup roller housing (40*a* or 40*b*) to shift toward the pin bearing to clamp the work roller against the bearing pin 1 or 2 and push it tightly against the pair of working rollers 28*a* disposed above and below the axis of the pin bearing 1 or the pin bearing 2.

Herein the respective rolling tool arms 22*a* and 22*b* are pivotally supported by a hanger member 90 (FIG. 5) which allows the arms to follow the eccentric path of a pin bearing 1 and 2, respectively, during the rotation of the crankshaft 14. To these ends the hanger member 90 is pivotally connected to the respective rolling arm 22*a* or 22*b* by a lower pivot connection 92. There is an upper pivot connection 94 which is connected to a suspension structure which is not shown in this application, but which is fully described in the aforementioned U.S. Pat. No. 6,895,793. Each rolling arm may be pivoted vertically up or down about the lower pivot connection 92 and it may be moved back or forward in the fore and aft direction by swinging about the upper pivot connection 94. This action allows an orbital pivoting of the tool arms while the work and backup rollers are clamped onto the pin bearings 1 and 2. Because of the narrow width of the respective rolling arms 22*a* and 22*b*, as well as the hanger members 90 and the thin power assembly 78, all of the crankshaft bearings can be rolled in a single operation with the tool arms all being disposed to one side of the crankshaft, as illustrated in FIG. 6, for ease of loading and unloading of the crankshaft, as disclosed in the aforesaid '793 patent.

From the foregoing it will be seen that in the illustrated embodiment, each rolling tool assembly has two work rollers set at approximately a 90 degree angle to each other for each of the arcuately offset, split pin bearing being rolled. The work rollers using equal forces stabilize the rolling tool heads from twisting sideways, thus keeping each tool head and friction surfaces of their respective housings, flat or flush against the wear plate during the rolling process. A separate tool housing is provided for the back-up roller. These tool housings for both the working rollers and back-up roller are mounted to a single rolling arm as described in the '793 patent.

As can be seen in the drawings and from the foregoing description in this illustrated embodiment, each double-roller tool housing 38*a* and 38*b* includes a pair of work rollers 28*a*, 28*b* with there being a single back-up roller 26*a*, 26*b* in the tool housing therefor. When engaged against the split pin bearings, one of the pair of work rollers will be above the bearing horizontal plane extending through the crankshaft axis and the other work roller will be below the horizontal plane with the work tool at the horizontal plane. The forces on each of the tool housings above and below this horizontal plane will thus tend to be equalized so that neither of the housings is urged to tip or twist sideways as would create unequal rubbing of the tool housings that would create undue wear and high and low spots on the housings. Thus, there is provided more even distribution of reactive work forces so that the tool housings tend to stay more vertically oriented in a direction perpendicular to the bearing centerline and the crankshaft axis, and tend to stay flush against the bearing plate therebetween.

Also, as can be seen in the above-identified drawings and description, in this illustrated embodiment, rear portions 50*a* of the adjacent tool arms are stabilized to maintain a parallel relationship of the tool arms. This is achieved by providing outer stops 52 on the sides of the arms to limit their movement toward or from each other. An inner stop 53 limits arm movement toward each other. The inner, spacer stop 53 is wide enough to take up the space between adjacent inner facing surfaces on the end portions of the arms to limit movement of these end portions toward one another. In the illustrated embodiment, the front portions of the tool arms having the tool heads are stabilized against twisting and the rear portions are also stabilized against twisting or shifting sideways.

The terms vertical and horizontal are used herein to assist in understanding and visualizing the preferred and illustrated embodiment. Manifestly, the work tools and the tool arms could be shifted to be vertical or at other inclinations rather then the described horizontal position for the arms.

While there had been described and illustrated a particular embodiment of the present invention, it will be appreciated that numerous changes and modifications will occur to those skilled in the art and it is intended in the appended claims to cover all those changes and modifications which fall within the true spirit and scope of the present invention.

What is claimed is:

1. A method of rolling outer fillets of adjacent split pin bearings on a crankshaft using work rollers on adjacent rolling tools mounted on adjacent tool arms comprising:

positioning the adjacent rolling tool heads to rub against one another and with each tool offset from the other because the centerlines of the adjacent pin bearings are offset from each other;

engaging each pin bearing with at least one backup roller; and engaging each outer pin fillet with a work roller on one side of the pin bearing centerline and with a work roller on the other side of the pin bearing centerline to lessen any uneven distribution of reactive work forces about the bearing centerline in order to maintain the rolling tools perpendicular to their respective bearing centerlines and to the axis of the crankshaft.

2. A method of rolling in accordance with claim 1 comprising:

positioning the crankshaft axis substantially horizontally and positioning one work roller above the axis and one roller below the axis.

3. A method of rolling in accordance with claim 1 comprising:

engaging a single backup roller on the opposite side of the crankshaft to form a triangle of engagement points for each of the adjacent work tools with its respective pin bearing.

4. A method in accordance with claim 3 comprising:

positioning the respective work rollers at substantially 45° C. above and below the respective pin axis for each of the split pin bearings.

5. A rolling method in accordance with claim 1 comprising:

providing one work tool with a steel housing and the adjacent work tool with a bronze housing.

6. A rolling method in accordance with claim 1 comprising:

stabilizing rolling tool arms each carrying a rolling tool from moving side-to-side during a rolling operation to maintain a parallel relationship of the adjacent rolling tool arms.

7. A rolling method in accordance with claim 6 comprising:

providing stops to keep the rolling tool arms from shifting side-to-side.

8. A rolling method in accordance with claim 7 comprising:

supporting the tool arms for travel forwardly and rearwardly as the split pin bearings orbit about a rotational axis of a rotating crankshaft; and stabilizing the tool arms at rearward ends thereof.

9. A method in accordance with claim 8 wherein the stabilizing of the tool arms comprises:

positioning a spacer stop between rearward ends of the respective tool arms to limit sideways movement of the end portions towards one another; and positioning the stops to limit sideways movement of the end portions away from each other.

10. A method in accordance with claim 1 comprising:

mounting the work rollers and the backup roller on the same tool arm; and moving the work rollers and backup roller relative to one another to clamp against a split pin bearing and to shift to an open position spaced from the crankshaft pin bearing.

11. A method of rolling outer fillets of adjacent split pin bearings of a crankshaft with work rollers on rolling tools comprising:

providing an adjacent pair of tool arms each for supporting at least one work roller and for allowing the work rollers to travel at its forward ends about a rocking path as the pin bearing orbits about a rotational axis for the crankshaft;

supporting the tool arms at rear portions thereof to allow the tool arms to swing backwards and forwards;

imparting forces at the work rollers and forward ends of the respective tool arms to rock the tool arms tending to separate the tool arms at their respective rear portions; and stabilizing the rear portion of the adjacent tool arms to maintain a parallel relationship of the tool arms.

12. A method in accordance with claim 11 wherein the stabilizing comprises:

providing stops to limit the rear portions of the tool arms from shifting relative to one another.

13. A method in accordance with claim 12 comprising:

positioning a spacer stop between the adjacent rear portions of the tool arms to limit shifting of the rearward ends toward one another.

14. A method in accordance with claim 11 comprising:

positioning a tool head on each of the tool arms adjacent one another for rubbing engagement relative to one another to resist sideways forces exerted during the split pin rolling operation; and carrying work rollers and a backup roller on each tool arm for engagement with a respective split pin bearing.

15. A method in accordance with claim 14 comprising:

positioning one working roller above the centerline of the split pin bearing and one working roller below the centerline of the split pin bearing when rolling outer fillets of the split pin bearing.

16. A method in accordance with claim 15 comprising:

positioning a single backup roller in substantial alignment with the axis of the split pin bearing on the side of the bearing opposite the working rollers.

17. In a rolling tool apparatus for a rolling hardening of offset, adjacent pin bearings of a crankshaft, the rolling tool apparatus comprising:

a first tool head having work and backup rollers for roll hardening a first one of the split pin bearings;

a second tool head having work and backup rollers for hardening the other of the adjacent split pin bearings;

friction surfaces associated with first and second tool heads positioned adjacent one another for frictional sliding engagement as the tool heads follow the orbital path of their respectively engaged offset, split pin bearings; and the work rollers and the backup rollers being positioned and engaging the respective split pin bearings to stabilize the housings in parallel planes normal to an axis of rotation of the crankshaft.

18. The apparatus of claim 17 wherein a pair of work rollers are positioned on opposite sides of a centerline through the pin bearing and at least one backup roller is positioned on the opposite side of the split pin bearing.

19. The apparatus of claim 17 wherein the work rollers are positioned at equal angles to a plane through the center of the pin bearing.

20. The apparatus of claim 17 wherein the work rollers are positioned at equal angles above and below a horizontal plane through the pin bearing; and a single backup roller is positioned in the horizontal plane and opposite the respective work rollers with equal angels with respect thereto.

21. The apparatus of claim 17 wherein the work rollers and the backup rollers define three engagement points with the bearing, which three points define a triangle.

22. In an apparatus for a roll hardening of offset, split pin bearings of a crankshaft, the apparatus comprising;

a pair of adjacent tool arms;

a tool head on each of the adjacent tool arms;

the tool head being positioned closely adjacent each other to roll harden a first and second pin bearing for the split pin bearing with frictional surfaces between the housings assisting in maintaining the tool housings in parallel planes as the split pin bearings rotate;

work and backup-up rollers being positioned in the respective, adjacent tool heads to engage their respective split pin bearings at engagement points stabilizing their respective tool heads from twisting from a plane normal to a rotational axis of the crankshaft; and positioning stops engaging rear portions of the adjacent tool arms to retain their respective tool arms evenly spaced as the rear portions move with movement of their respective tool arm.

23. An apparatus in accordance with claim 22 comprising:

a first work roller of each tool head engaging a split pin bearing on one side of a centerline at a predetermined angle to the centerline;

a second work roller of each tool head engaging a split pin bearing on an opposite side of the centerline at the predetermined angle; and at least one backup roller of each tool head opposite the first and second work rollers.

24. An apparatus in accordance with claim 23 wherein a single backup roller is disposed at the centerline of the pin bearing, points of engagement of the backup roller and the two work rollers with the split pin bearing defining a triangle of engagement points to stabilize the tool housing against twisting.

25. An apparatus in accordance with claim 22 wherein the positioning stops comprise:

an outer stop on outboard sides of adjacent tool arms to limit the shifting of the rear portions in a direction from each other; and a spacer stop for the inboard sides of the respective tool arms to limit travel of the rear portions toward each other.

* * * * *

UNITED STATES PATENT AND TRADEMARK OFFICE

CERTIFICATE OF CORRECTION

PATENT NO. : 7,188,500 B2
APPLICATION NO. : 11/142849
DATED : March 13, 2007
INVENTOR(S) : Bramwell W. Bone It is certified that error appears in the above-identified patent and that said Letters Patent is hereby corrected as shown below:

Claim 4, column 7, line 65-66 after "45°" delete "C.".

(From Application, page 13, claim 4).

Signed and Sealed this

Twenty-ninth Day of May, 2007

JON W. DUDAS
*Director of the United States Patent and Trademark Office*